United States Patent [19]

Nobel et al.

[11] Patent Number: 4,628,165

[45] Date of Patent: Dec. 9, 1986

[54] ELECTRICAL CONTACTS AND METHODS OF MAKING CONTACTS BY ELECTRODEPOSITION

[75] Inventors: Fred I. Nobel, Sands Point; James L. Martin, Merrick; Michael P. Toben, Smithtown, all of N.Y.

[73] Assignee: LeaRonal, Inc., Freeport, N.Y.

[21] Appl. No.: 774,634

[22] Filed: Sep. 11, 1985

[51] Int. Cl.[4] ..... H01H 1/02; C25D 3/56; C25D 5/10

[52] U.S. Cl. ..... 200/268; 200/269; 204/40; 204/44.6; 428/669; 428/670; 428/673; 428/674; 428/680

[58] Field of Search ..... 428/670, 669, 674, 673, 428/680; 204/40; 200/268, 269

[56] References Cited

U.S. PATENT DOCUMENTS

| | | | |
|---|---|---|---|
| 3,053,741 | 9/1962 | Medina | 204/43 |
| 4,100,039 | 7/1978 | Caricchio, Jr. et al. | 204/43 N |
| 4,269,671 | 5/1981 | Cohen et al. | 204/23 |
| 4,463,060 | 7/1984 | Updegraff | 428/669 |
| 4,465,563 | 8/1984 | Nobel | 204/43 N |
| 4,478,692 | 10/1984 | Nobel | 204/43 R |
| 4,529,667 | 7/1985 | Shiga et al. | 428/646 |

FOREIGN PATENT DOCUMENTS

| | | | |
|---|---|---|---|
| 440591 | 4/1947 | Canada | 204/43 R |
| 154013 | 12/1980 | Japan | 200/269 |

*Primary Examiner*—G. L. Kaplan
*Attorney, Agent, or Firm*—Pennie & Edmonds

[57] ABSTRACT

Methods for increasing the ductility and reducing the porosity and cracking tendency of a palladium or palladium-silver electrodeposit which comprises providing an underlayer of a palladium/nickel or palladium/-cobalt alloy electrodeposit. Also dual layer composite electroplated deposits and their use in electrical contacts or connectors.

21 Claims, No Drawings

ELECTRICAL CONTACTS AND METHODS OF MAKING CONTACTS BY ELECTRODEPOSITION

TECHNICAL FIELD

This invention relates generally to composite electroplated palladium or palladium alloys. More particularly, the invention relates to the electrodeposition of a first layer of palladium/nickel or palladium/cobalt onto a suitable substrate followed by the electrodeposition of a second layer of palladium or palladium/silver to form the composite alloy.

BACKGROUND OF INVENTION

Palladium and palladium alloys have been traditionally used as contact surfaces for electrical contacts and connectors. Primarily, these alloys have been used in the form of wrought alloys or clad inlays as a replacement for gold in such applications. In recent years, many manufacturers of electrical contacts and connectors have been seeking methods to electroplate palladium or palladium alloys since, in many applications, electroplating would be more economical.

Many electrical contacts are manufactured by first electroplating a precious metal deposit in the form of a narrow band or stripe onto a wider strip or surface area of basis metal using high speed, reel-to-reel plating equipment. The electoplated strip is then stamped and formed into a contact with the precious metal electrodeposit located at the exact point where contact is to be made with the mating part. The electrodeposit on this formed part must be tightly adherent, sound, crack-free, and porosity-free, even after the stamping and forming operations. In order for an electrodeposit to withstand such operations, it must have sufficient ductility, good adhesion to the base metal, and freedom from porosity in the electroplated condition. Cracking of the electrodeposits cannot be tolerated in the final product. The electrodeposit should have sufficient ductility to withstand the stresses of stamping and forming without producing further cracks, pores or peeling from the substrate.

U.S. Pat. No. 4,269,671 discloses a method for electrodepositing a 60% by weight palladium 40% by weight silver alloy from a highly acidic solution containing a large amount of chloride ion. While the alloy obtained is a sound deposit, the plating solution is highly corrosive and causes severe displacement reactions to take place between the plating solution and the basis metal to be plated. These basis metals generally indude copper, nickel or their alloys. This type of high chloride plating solution for palladium/silver alloys as well known in the art as evidenced by Canadian Pat. No. 440,591. U.S. Pat. No. 4,269,671 discloses that the copper or nickel basis metals can be protected from the highly corrosive nature of such high chloride plating baths by first coating the basis metal with a thin layer of a precious metal. The precious metals suggested are silver and soft gold with the latter being preferred.

U.S. Pat. No. 4,463,060 describes a permanently solderable palladium/nickel electrodeposit of a thickness of about 0.1 to 1.5 micrometers having about 46 to 82 atomic percent palladium, balance nickel. This layer is covered by an extremely thin (i.e., about 20 angstroms) second layer of almost pure palladium. The second layer of palladium is formed not by electroplating, but by dipping the first layer into a solution of sulfuric or hydrochloric acid. This combination is described as forming a permanently solderable palladium/nickel electrodeposit.

SUMMARY OF THE INVENTION

The invention relates to a method for electroplating a dual layer palladium alloy deposit which comprises electrodepositing a first layer of a palladium/nickel or palladium/cobalt alloy upon a substrate in a thickness sufficient to increase the ductility and reduce the porosity and tendency for cracking in the electrodeposit and electrodepositing a second layer of palladium or palladium/silver upon the first layer in a thickness sufficient for use as an electrical contact surface.

The invention also relates to the dual layer electrodeposit produced by this method. This dual layer electrodeposit comprises a first layer of a palladium/nickel or palladium/cobalt alloy and a second layer of palladium or palladium/silver. The most advantageous palladium/nickel or palladium/cobalt alloy comprises between abut 50 and 95 weight percent palladium, balance nickel or cobalt, while the preferred palladium/silver alloy comprises between about 40 and 80 weight percent palladium, balance silver.

Preferably, the first layer has a thickness of at least about 0.5 microinch and the second layer has a thickness of about at least about 5 microinches.

Another aspect of the invention relates to an electrical contact comprising a metal substrate and the composite electrodeposit described previously. In this contact, the metal substrate usually comprises copper, nickel, or one of their alloys.

A further aspect of the invention relates to a method for reducing corrosion of a copper, nickel or copper/-nickel basis metal substrate during electroplating of palladium/silver alloys from an acidic, high chloride electroplating bath which comprises electroplating a sufficient amount of a first layer of a palladium/nickel or palladium/cobalt alloy upon the substrate prior to electroplating the palladium/silver alloy. In this embodiment, a preferred thickness for the palladium/-nickel or palladium/cobalt layer is at least about 10 microinches.

DETAILED DESCRIPTION OF THE INVENTION

In order to achieve the composite alloy electrodeposits of palladium or palladium alloys according to the invention, it has surprisingly been found that a thin undercoating of a palladium/nickel or palladium/cobalt alloy, preferably containing about 20–95 and most preferably about 60–80% by weight palladium, is capable of substantially improving the ductility and reducing the porosity characteristics of the overall electrodeposit. The preferred commercial thickness of the composite is generally from about 20 to 60 microinches.

When plating such relatively thin deposits onto copper, nickel or their alloys, it is very difficult to obtain ductile and porosity-free electrodeposits even if the basis metal is first coated with a thin layer of gold, silver, or pure palladium. When a palladium/nickel or palladium/cobalt alloy is used as a thin undercoating, however, its combination deposit with pure palladium or palladium/silver alloys shows significant improvements in ductility and reduction of cracking and porosity.

A preferred palladium/nickel alloy plating bath is one which contains the following:

| | |
|---|---|
| Palladium metal (as palladium tetra-amine dichloride) | 5–25 grams/liter |
| Nickel metal (as nickel ammonium chloride) | 3–15 grams/liter |
| Ammonium chloride | 10–100 grams/liter |
| Addition agent | 0–15 grams/liter |
| Temperature | 100–125° F. |
| pH | 7–9 |

Ammonium chloride is used as a complexing agent to maintain the metals in solution. Other suitable complexing agents include any solution soluble ammonium salt or compound.

The addition agent is an organic compound or salt of an organic compound which imparts brightness and other desirable metallurgical characteristics to the deposit. Suitable addition agents include: sodium vinyl sulfonate, saccharin, sodium salts of benzene or naphthalene sulfonic acids, nicotinic acid, nicotinamide, and quaternized pyridinium compounds, with the latter being preferred. The most preferred palladium-nickel or palladium-cobalt alloy electrodeposits contain 75% palladium and 25% nickel or cobalt by weight, although any deposit containing about 50 to 95 weight percent palladium, balance nickel or cobalt, can be used. The pH of the bath is adjusted to the desired range of about 7–9 with ammonium hydroxide or any other base or basic component.

To obtain a palladium/cobalt alloy, the same bath as for palladium/nickel can be used except that slightly higher amounts (i.e., about 5–25 g/l) of cobalt metal are substituted for the nickel metal. Also, the pH for these palladium/cobalt baths may be as low as about 6.

When the second layer is pure palladium, it can be obtained from any prior art palladium electroplating solution, providing that such solution is capable of producing a sound, crack-free deposit.

Preferred palladium plating baths fall generally within the following formula:

palladium metal (as palladium amine chloride) 8–30 grams/liter
free ammonia or amine 5–50 grams/liter
addition agent 0–10 grams/liter
conductivity salt 0–50 grams/liter
pH 7–9.5
temperature 100°–140° F.

Suitable addition agents include those listed above for palladium/nickel or palladium-cobalt electroplating. Also, suitable conductivity salts include any bath soluble organic or inorganic compound such as, chloride, phosphate, pyrophosphate or like substituents capable of increasing electrical conductivity of the plating bath.

When palladium/silver is deposited as the second layer, the electroplating bath must be capable of producing a sound electrodeposit with the most preferred alloy being 60% palladium, 40% silver by weight. Such a deposit can be obtained from the bath described in U.S. Pat. No. 4,269,671 or Canadian Pat. No. 440,591. Since the baths of these patents are highly corrosive, the palladium/nickel or palladium/cobalt first layer must have a thickness of at least about 10 microinches before the palladium/silver alloy is electrodeposited to prevent corrosion of the basis metal substrate during the electroplating of palladium/silver.

Acid palladium/silver electroplating baths are described in U.S. Pat. Nos. 4,478,692 and 4,465,563. These patents describe chloride-free electroplating baths containing strong acids for depositing sound palladium/silver alloys suitable for this invention. Other palladium/silver plating baths have been described by Medina in U.S. Pat. No. 3,053,741 which claims non-porous deposits from plating baths based upon the ammoniacal nitrate solution of palladium and silver at a pH of 7.5–11. Other alkaline palladium/silver electrolytes capable of producing sound, crack-free and porosity-free electrodeposits of palladium/silver alloys are described in the assignee's copending application, Ser. No. 742,258, filed June 7, 1985, now abandoned. Generally, such palladium/silver alloys have a palladium content of between about 20 and 95 weight percent palladium, balance silver. Since the cost of high palladium content alloys is relatively expensive, the usual practice is to use less than 80 weight percent palladium. As mentioned above, the most preferred palladium/silver alloys are thos containing between 40 and 80 weight percent palladium, balance silver, and specifically 60 weight percent palladium, 40 weight percent silver. To the extent that these patents disclose such suitable baths and deposition processes, their content is expressly incorporated by reference herein.

The thickness of the palladium/nickel or palladium/cobalt undercoating would vary from about 0.5 to 50 microinches or more depending upon the bath and alloy selected for the second layer. A preferred thickness range is about 5 to 10 microinches. When the high chloride acidic plating electrolytes for palladium/silver are used, the thickness of the first layer should be at least about 10 to 20 microinches.

The thickness of the second layer is that which is sufficient to provide the necessary properties for the intended application. Typically, at least 2 microinches is utilized, and preferably between about 5 and 100 microinches. There is no upper limit for the thickness of the second layer, although it is unusual to have more than about 250 microinches due to economic factors. Typically, the deposit thickness of the composite ranges from about 20 to 60 microinches, since this thickness range is generally specified by the electrical contacts industry.

EXAMPLES

The scope of the invention is further described in connection with the following examples which are set forth for the sole purpose of illustrating the preferred embodiments of the invention and which are not to be construed as limiting the scope of the invention in any manner.

Example 1 (Prior Art)

30 microinches of pure palladium was electroplated onto a copper strip using conventional electroplating procedures. The electrolyte used contained the following:

palladium metal (as palladium tetraamino dichloride) 10 grams/liter
ammonium chloride: 50 grams/liter
quaternized pyridine: 1 gram/liter
pH 7.5
temperature 120° F.
current density 15 ASF After plating, the strip was tested for porosity using the conventional electrographic porosity test. Another sample of strip was subjected to a bend test commonly used in the industry, described by J. Edwards, Trans. Inst. Met. Fin. Vol. 35, 1958. In this test, the electroplated strip is bent around a logarithmic former, and the deposit is examined for cracks and porosity.

Results showed some porosity before the bend test, but considerably increased porosity and cracking after the bend test.

Example 2

A copper strip was first plated with 5 microinches of a 70% palladium/30% nickel alloy followed by 25 microinches of the pure palladium deposit obtained by the electroplating procedure of Example 1. The palladium-nickel electrolyte was as follows:

| | |
|---|---|
| palladium metal (as palladium tetraamino dichloride) | 10 grams/liter |
| nickel metal (as nickel ammonium chloride) | 5 grams/liter |
| ammonium chloride | 50 grams/liter |
| quaternized pyridine | 1 gram/liter |
| pH 7.5 | |
| temperature 120° F. | |
| current density 15 ASF | |

The combined thickness of the resultant electrodeposit was the same as in Example 1.

Results showed slight porosity before the bend test, but this example showed a significant improvement in both porosity and cracking after the bend test compared to results of Example 1.

Example 3 (Prior Art)

A 60% palladium/40% silver alloy was obtained from an electroplating solutions described in U.S. Pat. No. 4,478,692 in accordance with the following:

| | |
|---|---|
| palladium metal (as palladium sulfate) | 12 g/l |
| silver metal (as silver nitrate) | 0.7 g/l |
| methane sulfonic acid | 150 ml/l |
| temperature | 130° F. |
| current density | 10 ASF |

A copper strip was prepared for plating using conventional procedures, then plated with about 5 microinches silver from a conventional silver cyanide plating solution, followed by 25 microinches of palladium-silver alloy from the above electrolyte. A porosity test before bending showed some porosity, however, after the bend test, the porosity increased dramatically and substantial cracking of the deposit was observed.

Example 4 (Prior Art)

Example 3 was repeated, however, this time a 5 microinch gold undercoat was used in place of silver. The test results obtained for this example were essentially the same as those obtained in Example 3.

Example 5

Example 3 was repeated, however, this time a 5 microinch undercoat of a 70% palladium/30% nickel alloy was first plated onto the copper strip. This was followed by the palladium/silver deposit to a thickness of about 25 microinches. The porosity test showed slight porosity before the bend test, but the deposit of this example showed a significant improvement in both porosity and cracking after the bend test as compared with results of Examples 3 and 4.

Example 6

Example 1 was repeated, however, this time a 5 microinch undercoat of pure palladium was used from a palladium tetramine dichloride bath followed by the palladium/silver electrodeposit of Example 3 to a total thickness of 25 microinches. Porosity and cracking characteristics of this composite electrodeposit were not as good as those of Example 5, but were improved over the results of Examples 3 and 4.

Examples 7–10

Examples 3–6 were repeated, however, this time the palladium/silver alloy deposit was obtained from solutions described in assignee's copending application Ser. No. 742,258, filed June 7, 1985. Results were substantially the same as those of Examples 3–6.

Example 11

A copper strip was first plated wth 5 microinches of a 90% palladium/10% cobalt alloy followed by 25 micro inches of the pure palladium deposit obtained by the electroplating procedure of Example 1. The palladium/cobalt electrolyte was as follows.

| | |
|---|---|
| palladium metal (as palladium tetraamino dichloride) | 12 grams/liter |
| cobalt metal (as cobalt chloride) | 12 grams/liter |
| ammonium chloride | 75 grams/liter |
| quaternized pyridine | 1 gram/liter |
| pH 6.3 | |
| temperature 140° F. | |
| current density 15 ASF | |

The combined thickness of the resultant electrodeposit was the same as in Example 1.

Results showed slight porosity before the bend test, but this example showed a significant improvement in both porosity and cracking after the bend test compared to results of Example 1.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

We claim:

1. A method for increasing the ductility and reducing the porosity or tendency for cracking in a dual layer palladium alloy electrodeposit upon a substrate which comprises:

electrodepositing a first layer of a palladium/nickel or palladium/cobalt alloy comprising between about 20 and 95 weight percent palladium and between about 5 and 80 weight percent nickel or cobalt upon the substrate in a thickness of at least about 0.5 microinches to increase the ductility and reduce the porosity and tendency for cracking of the dual layer electrodeposit; and electrodepositing a second layer of palladium or a palladium/silver alloy upon said first layer in a thickness of greater than about 5 microinches for use as an electrical contact, said second layer having a thickness greater than said first layer.

2. An article comprising a substrate and the dual layer electrodeposit produced by the method of claim 1.

3. The article of claim 2 wherein the metal substrate comprises copper, nickel, or one of their alloys.

4. A palladium or palladium/silver electrical contact comprising a substrate and a dual layer electrodeposit comprising at least about 0.5 microinches of a first layer of a palladium/nickel or palladium/cobalt alloy comprising between about 20 and 95 weight percent palladium and between about 5 and 80 weight percent nickel or cobalt and greater than about 5 microinches of a second layer of palladium or a palladium/silver alloy; said second layer being thicker than said frist layer and providing the electrical characteristics of the electrical contact.

5. The electrical contact of claim 4 wherein the first layer of the electrodeposit has a thickness of greater than about 5 microinches.

6. The electrical contact of claim 4 wherein the second layer of the electrodeposit has a thickness of greater than about 20 microinches.

7. A method for reducing corrosion of a copper, nickel or copper/nickel alloy basis metal substrate during electroplating of palladium/silver alloys from an acidic, high chloride electroplating bath which comprises electroplating at least 0.5 microinches of a first layer of a palladium/nickel or palladium/cobalt alloy comprising between about 20 and 95 weight percent palladium and between about 5 and 80 weight percent nickel or cobalt upon the substrate prior to electroplating the palladium/silver alloy to reduce or prevent corrosion of the basis metal during electroplating of the palladium/silver alloy.

8. The method of claim 7 wherein the thickness of the palladium/nickel or palladium/cobalt layer is at least about 10 microinches.

9. A method for electroplating a dual layer palladium alloy deposit which comprises:

electrodepositing a first layer of a palladium/nickel or palladium/cobalt alloy comprising between about 20 and 95 weight percent palladium and between about 5 and 80 weight percent nickel or cobalt upon a substrate in a thickness greater than about 0.5 microinches to increase the ductility and reduce the porosity and tendency for cracking in the dual layer electrodeposit; and electrodepositing a second layer of palladium or a palladium/silver alloy comprising between about 20 and 95 weight percent palladium and between about 5 and 80 weight percent silver upon said first layer in a thickness of at least about 5 microinches for use as an electrical contact; the thickness of said second layer being greater than the thickness of said first layer.

10. An article comprising a substrate and the dual layer electrodeposit produced by the method of claim 9.

11. A palladium/silver electrical contact comprising a substrate and a composite electrodeposit comprising greater than about 0.5 microinches of a first layer of a palladium/nickel or palladium/cobalt alloy comprising between about 20 and 95 weight percent palladium and between about 5 and 80 weight percent nickel or cobalt upon said substrate and at least about 5 microinches of a second layer of a palladium/silver alloy comprising between about 20 and 95 weight percent palladium and between about 5 and 80 weight percent silver upon said first layer.

12. The electrical contact of claim 11 wherein the palladium/nickel or palladium/cobalt layer of the electrodeposit has a thickness of at least about 10 microinches.

13. The electrical contact of claim 11 wherein the palladium/silver layer of the electrodeposit has a thickness of about 25–60 microinches.

14. The electrical contact of claim 11 wherein the palladium/silver alloy of the electrodeposit comprises between about 40 and 80 weight percent palladium, balance silver.

15. The electrical contact of claim 11 wherein the palladium/nickel or palladium/cobalt alloy of the electrodeposit comprises between about 50 and 95 weight percent palladium, balance nickel or cobalt.

16. A method for making an electrical contact having a contact surface of palladium which comprises initially electrodepositing a first layer of a palladium/nickel or palladium/cobalt alloy comprising between about 20 and 95 weight percent palladium and between about 5 and 80 weight percent nickel or cobalt upon a substrate in a thickness of greater than 0.5 microinches before electroplating the palladium layer to increase the ductility and reduce the porosity and tendency for cracking in the dual layer electrodeposit; and electrodepositing a second layer of palladium upon said first layer in a thickness of at least about 5 microinches; the thickness of said second layer being greater than the thickness of said first layer, said second layer providing the electrical characteristics of the contact.

17. An article comprising a substrate and the dual layer electrodeposit produced by the method of claim 16.

18. A palladium electrical contact comprising a substrate and a composite electrodeposit comprising a first layer of greater than 5 microinches of a palladium/nickel or palladium/cobalt alloy comprising between about 20 and 95 weight percent palladium and between about 5 and 80 weight percent nickel or cobalt and greate than 20 microinches and a second layer of palladium; the thickness of the second layer being greater than that of the first layer and providing the electrical characteristics of the contact.

19. The electrical contact of claim 18 wherein the palladium/nickel layer of the electrodeposit has a thickness of at least about 10 microinches.

20. The electrical contact of claim 18 wherein the palladium layer of the electrodeposit has a thickness of between about 25 and 60 microinches.

21. The electrical contact of claim 18 wherein the palladium/nickel alloy of the electrodeposit comprises between about 50 and 95 weight percent palladium, balance nickel.

* * * * *